US008117674B2

(12) United States Patent
Warren et al.

(10) Patent No.: US 8,117,674 B2
(45) Date of Patent: Feb. 21, 2012

(54) METHOD OF FORMING GARMENTS HAVING SEAMLESS EDGE BANDS

(75) Inventors: Roger D. Warren, Claremont, NC (US); Rick Kelley, Germanton, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 0 days.

(21) Appl. No.: 12/944,017

(22) Filed: Nov. 11, 2010

(65) Prior Publication Data

US 2011/0048077 A1 Mar. 3, 2011

Related U.S. Application Data

(62) Division of application No. 11/032,285, filed on Jan. 10, 2005, now Pat. No. 7,854,022.

(51) Int. Cl.
*A41B 9/00* (2006.01)
*A41C 1/00* (2006.01)
*B32B 37/00* (2006.01)

(52) U.S. Cl. ..... 2/401; 450/151; 156/73.3

(58) Field of Classification Search ..... 2/401–404, 2/406, 407, 409, 275, 400, 274; 450/8, 39, 450/40, 65, 81, 82, 156; 156/1, 73.3, 73.1
See application file for complete search history.

(56) References Cited

U.S. PATENT DOCUMENTS

| | | | |
|---|---|---|---|
| 2,285,967 | A | 6/1942 | Hardy |
| 2,304,989 | A | 12/1942 | Snowdon |
| 2,551,811 | A | 5/1951 | Mueller |
| 2,617,102 | A | 11/1952 | MacHenry |
| 2,739,919 | A | 3/1956 | Artzt |
| 2,867,889 | A | 1/1959 | Thompson, Jr. |
| 2,915,067 | A | 12/1959 | Bracht |
| 2,962,025 | A | 11/1960 | Bertrand |
| 3,021,844 | A | 2/1962 | Flagg et al. |
| 3,070,870 | A | 1/1963 | Alexander at al. |
| 3,164,655 | A | 1/1965 | Howard et al. |
| 3,168,749 | A | 2/1965 | Cala |

(Continued)

FOREIGN PATENT DOCUMENTS

EP 1166659 A2 1/2002

(Continued)

OTHER PUBLICATIONS

International Search Report for PCT/US06/00705 dated Jan. 11, 2008, ISA/US.

*Primary Examiner* — Alissa L Hoey
(74) *Attorney, Agent, or Firm* — Womble Carlyle Sandridge & Rice PLLC

(57) ABSTRACT

A method is provided for forming a garment, including providing a fabric layer having sonically weldable material, the fabric layer having an inner surface and at least one opening region, the opening region having a periphery and an outer free edge, placing an elastic edge band having sonically weldable material around the entire periphery of the opening region, the edge band having first and second free edges and an inner surface, securing the first free edge of the edge band to the outer free edge of the opening region with a subsonic or ultrasonic edge weld to form a finished seamless edge along the opening region, and activating an adhesive along more than half of the inner surface of the edge band to secure the edge band and second free edge to the inner surface of the fabric layer.

7 Claims, 3 Drawing Sheets

U.S. PATENT DOCUMENTS

| | | | | |
|---|---|---|---|---|
| 3,225,768 | A | 12/1965 | Galitzki et al. | |
| 3,228,401 | A | 1/1966 | Bryne | |
| 3,254,402 | A | 6/1966 | Balmuth et al. | |
| 3,312,224 | A | 4/1967 | Coates et al. | |
| 3,317,645 | A | 5/1967 | Nirenberg | |
| 3,320,346 | A | 5/1967 | Galitzki | |
| 3,327,707 | A | 6/1967 | Storti | |
| 3,383,263 | A | 5/1968 | Storti | |
| 3,417,755 | A | 12/1968 | Howard | |
| 3,465,755 | A | 9/1969 | Grishman | |
| 3,497,415 | A | 2/1970 | Adachi | |
| 3,502,083 | A | 3/1970 | Howard et al. | |
| 3,560,292 | A | 2/1971 | Butter | |
| 3,568,681 | A | 3/1971 | Comollo | |
| 3,574,520 | A | 4/1971 | Aldrich | |
| 3,597,800 | A | 8/1971 | Silverman | |
| 3,604,015 | A * | 9/1971 | Dove | 2/402 |
| 3,663,962 | A | 5/1972 | Burger | |
| 3,750,673 | A | 8/1973 | Penrock | |
| 3,755,058 | A | 8/1973 | Winkler | |
| 3,789,098 | A | 1/1974 | Cole et al. | |
| 3,799,174 | A | 3/1974 | Howard | |
| 3,828,367 | A | 8/1974 | Bourgeois | |
| 3,868,729 | A | 3/1975 | Lynam | |
| 3,874,963 | A | 4/1975 | Barger | |
| 3,881,041 | A | 4/1975 | Glienke | |
| 3,882,549 | A | 5/1975 | Gaburo | |
| 3,891,377 | A | 6/1975 | Howard | |
| 3,939,023 | A | 2/1976 | Magidson et al. | |
| 4,031,568 | A | 6/1977 | Huff | |
| 4,079,466 | A | 3/1978 | Rosenstein | |
| 4,090,900 | A | 5/1978 | Jacaruso et al. | |
| 4,135,025 | A | 1/1979 | Backes | |
| 4,148,322 | A | 4/1979 | Jacaruso et al. | |
| 4,172,002 | A | 10/1979 | Gluckin | |
| 4,190,010 | A | 2/1980 | Bibby | |
| 4,202,853 | A | 5/1980 | DiTullio | |
| 4,205,679 | A | 6/1980 | Repke et al. | |
| 4,259,220 | A | 3/1981 | Bunnelle et al. | |
| 4,276,109 | A | 6/1981 | Siewert et al. | |
| 4,324,245 | A | 4/1982 | Mesek et al. | |
| 4,337,771 | A | 7/1982 | Pieniak et al. | |
| 4,353,762 | A | 10/1982 | Bouda | |
| 4,355,425 | A | 10/1982 | Jones et al. | |
| 4,372,321 | A | 2/1983 | Robinson | |
| 4,375,445 | A | 3/1983 | Cole et al. | |
| 4,386,990 | A | 6/1983 | Gluckin | |
| 4,398,981 | A | 8/1983 | Ellis | |
| 4,400,227 | A | 8/1983 | Riemersma | |
| 4,418,123 | A | 11/1983 | Bunnelle et al. | |
| 4,419,997 | A | 12/1983 | Cole et al. | |
| 4,479,836 | A | 10/1984 | Dickover et al. | |
| 4,481,951 | A | 11/1984 | Cole et al. | |
| 4,486,192 | A | 12/1984 | Sigl | |
| 4,492,608 | A | 1/1985 | Hirsch et al. | |
| 4,496,407 | A | 1/1985 | Lowery, Sr. et al. | |
| 4,519,857 | A | 5/1985 | Clay | |
| 4,525,229 | A | 6/1985 | Suzuki et al. | |
| 4,532,819 | A | 8/1985 | Ross | |
| 4,542,771 | A | 9/1985 | Payet et al. | |
| 4,543,099 | A | 9/1985 | Bunnelle et al. | |
| 4,557,267 | A | 12/1985 | Cole | |
| 4,560,427 | A | 12/1985 | Flood | |
| 4,572,195 | A | 2/1986 | Hyams | |
| 4,610,681 | A | 9/1986 | Strohbeen et al. | |
| 4,618,384 | A | 10/1986 | Sabee | |
| 4,624,115 | A | 11/1986 | Safrit et al. | |
| 4,627,427 | A | 12/1986 | Arco | |
| 4,639,949 | A | 2/1987 | Ales et al. | |
| 4,641,381 | A | 2/1987 | Heran et al. | |
| 4,671,264 | A | 6/1987 | Frangi | |
| 4,693,771 | A | 9/1987 | Payet et al. | |
| 4,701,964 | A | 10/1987 | Bell et al. | |
| 4,703,706 | A | 11/1987 | Plante | |
| 4,710,189 | A | 12/1987 | Lash | |
| 4,719,261 | A | 1/1988 | Bunnelle et al. | |
| 4,726,807 | A | 2/1988 | Young et al. | |
| 4,755,242 | A | 7/1988 | Miller et al. | |
| 4,771,483 | A | 9/1988 | Hooreman et al. | |
| 4,776,916 | A | 10/1988 | Prunesti et al. | |
| 4,875,241 | A | 10/1989 | Browder, Jr. et al. | |
| 4,895,569 | A | 1/1990 | Wilson et al. | |
| 4,920,769 | A | 5/1990 | Rickerl | |
| 4,938,821 | A | 7/1990 | Soderlund et al. | |
| 4,968,313 | A | 11/1990 | Sabee | |
| 4,976,706 | A | 12/1990 | Aki et al. | |
| 5,042,176 | A | 8/1991 | Rudy | |
| 5,140,757 | A | 8/1992 | Terada | |
| 5,154,659 | A | 10/1992 | Gluckin | |
| 5,163,932 | A | 11/1992 | Nomura et al. | |
| 5,193,225 | A | 3/1993 | Karami et al. | |
| 5,204,997 | A | 4/1993 | Suzuki et al. | |
| 5,229,181 | A | 7/1993 | Daiber et al. | |
| 5,234,523 | A | 8/1993 | Battreall | |
| D342,997 | S | 1/1994 | Buck et al. | |
| 5,339,467 | A | 8/1994 | Brinkley | |
| 5,340,424 | A | 8/1994 | Matsushita | |
| 5,352,518 | A | 10/1994 | Muramoto et al. | |
| 5,406,646 | A | 4/1995 | Balit et al. | |
| 5,447,462 | A | 9/1995 | Smith et al. | |
| 5,498,468 | A | 3/1996 | Blaney | |
| 5,531,850 | A | 7/1996 | Herrmann | |
| 5,545,158 | A | 8/1996 | Jessup | |
| 5,569,234 | A | 10/1996 | Buell et al. | |
| 5,628,741 | A | 5/1997 | Buell et al. | |
| 5,669,996 | A | 9/1997 | Jessup | |
| 5,680,653 | A | 10/1997 | Mathis et al. | |
| 5,682,618 | A | 11/1997 | Johnson et al. | |
| 5,690,626 | A | 11/1997 | Suzuki et al. | |
| 5,782,191 | A | 7/1998 | Wong | |
| 5,800,418 | A | 9/1998 | Ahr | |
| 5,807,368 | A | 9/1998 | Helmer | |
| 5,820,443 | A | 10/1998 | Burr | |
| 5,946,944 | A | 9/1999 | Osborne | |
| 5,967,876 | A | 10/1999 | Kollmanthaler et al. | |
| 5,984,762 | A | 11/1999 | Tedeschi et al. | |
| 6,000,994 | A | 12/1999 | Salotto et al. | |
| 6,004,306 | A | 12/1999 | Robles et al. | |
| 6,041,446 | A | 3/2000 | Braunstein et al. | |
| 6,057,024 | A | 5/2000 | Mleziva et al. | |
| 6,070,542 | A | 6/2000 | Wong | |
| 6,079,343 | A | 6/2000 | Wong | |
| 6,083,212 | A | 7/2000 | Kumasaka | |
| 6,096,164 | A | 8/2000 | Benson et al. | |
| 6,125,664 | A | 10/2000 | Browder, Jr. | |
| 6,168,585 | B1 | 1/2001 | Cesco-Cancian | |
| 6,192,717 | B1 | 2/2001 | Rabinowicz | |
| 6,193,701 | B1 | 2/2001 | Van Gompel et al. | |
| 6,210,388 | B1 | 4/2001 | Widlund et al. | |
| 6,240,561 | B1 | 6/2001 | Mc Ginnis | |
| 6,240,563 | B1 | 6/2001 | Niedermeyer | |
| 6,240,569 | B1 | 6/2001 | Van Gompel et al. | |
| 6,286,144 | B1 | 9/2001 | Henderson et al. | |
| 6,316,687 | B1 | 11/2001 | Davis et al. | |
| 6,340,782 | B1 | 1/2002 | Kling et al. | |
| 6,503,235 | B2 | 1/2003 | Suzuki et al. | |
| 6,516,473 | B2 | 2/2003 | Saito | |
| 6,517,651 | B2 | 2/2003 | Azulay | |
| 6,578,504 | B2 | 6/2003 | Nelson et al. | |
| 6,613,033 | B1 | 9/2003 | Popp et al. | |
| 6,622,312 | B2 | 9/2003 | Rabinowicz | |
| 6,645,040 | B2 | 11/2003 | Rabinowicz et al. | |
| 6,649,251 | B1 | 11/2003 | Druecke et al. | |
| 6,764,478 | B2 | 7/2004 | Ashton et al. | |
| 6,793,650 | B2 | 9/2004 | Weber | |
| 6,797,088 | B2 * | 9/2004 | Solinski | 156/73.4 |
| 6,837,771 | B2 | 1/2005 | Falla | |
| 6,974,514 | B2 * | 12/2005 | Hamulski et al. | 156/73.1 |
| 7,045,028 | B2 * | 5/2006 | Betrabet et al. | 156/73.1 |
| 7,051,557 | B2 | 5/2006 | Mitchell et al. | |
| 7,131,888 | B2 | 11/2006 | Hsu | |
| 7,191,720 | B2 | 3/2007 | Thomas | |
| 7,201,744 | B2 | 4/2007 | Van Gompel et al. | |
| 7,214,120 | B2 | 5/2007 | Kaye et al. | |
| 7,228,809 | B2 | 6/2007 | Angelino et al. | |
| 7,258,762 | B2 | 8/2007 | Fowler | |
| 7,374,627 | B2 | 5/2008 | McCabe | |

| | | | |
|---|---|---|---|
| 7,407,427 | B2 | 8/2008 | Liu |
| 2001/0001300 | A1 | 5/2001 | Tolbert et al. |
| 2001/0016722 | A1 | 8/2001 | Matsushita et al. |
| 2002/0000684 | A1 | 1/2002 | Nakanishi |
| 2002/0052590 | A1 | 5/2002 | Zehner et al. |
| 2002/0056510 | A1 | 5/2002 | Erdos et al. |
| 2002/0111119 | A1 | 8/2002 | Johnson et al. |
| 2002/0151239 | A1 | 10/2002 | Aerts |
| 2002/0152775 | A1 | 10/2002 | Browder |
| 2003/0019251 | A1 | 1/2003 | Browder et al. |
| 2003/0066593 | A1 | 4/2003 | Kopelowicz |
| 2003/0131399 | A1 | 7/2003 | Forsyth et al. |
| 2003/0135184 | A1 | 7/2003 | Van Gompel et al. |
| 2003/0192351 | A1 | 10/2003 | Meckley et al. |
| 2004/0014394 | A1 | 1/2004 | Mitchell et al. |
| 2004/0151864 | A1 | 8/2004 | Thomas |
| 2004/0238103 | A1 | 12/2004 | Cano |
| 2005/0000622 | A1 | 1/2005 | Cano |
| 2005/0097658 | A1 | 5/2005 | Lyons et al. |
| 2005/0159078 | A1 | 7/2005 | Querquant |
| 2007/0088312 | A1 | 4/2007 | Langdon et al. |
| 2008/0196136 | A1 | 8/2008 | Fellouhe et al. |
| 2008/0282451 | A1 | 11/2008 | Simpson |
| 2009/0088713 | A1 | 4/2009 | Norrby |

FOREIGN PATENT DOCUMENTS

| | | | |
|---|---|---|---|
| EP | 1226767 | A2 | 7/2002 |
| GB | 2051653 | A | 1/1981 |
| JP | 8060410 | A | 3/1996 |
| JP | 10298804 | A | 11/1998 |
| JP | 11172505 | A | 6/1999 |
| JP | 200288523 | A1 | 3/2002 |

* cited by examiner

METHOD OF FORMING GARMENTS HAVING SEAMLESS EDGE BANDS

CROSS REFERENCE TO RELATED APPLICATION

This application is a divisional of U.S. patent application Ser. No. 11/032,285, filed on Jan. 10, 2005 now U.S. Pat. No. 7,854,022, the entirety of which is herein incorporated by reference.

BACKGROUND OF THE INVENTION

1. Field of the Invention

The present invention relates to garments. More particularly, the present invention relates to garments having edge bands seamlessly secured thereto and processes for making such garments.

2. Description of Related Art

Many types of garments require bands secured to the edge of the garment. In some instances, the bands provide elasticity to the edge of the garment to maintain the garment in a desired location when worn. For example, intimate apparel garments such as, but not limited to, briefs and panties include an elastic waistband and often include elastic leg bands. Garments such as brassieres include an elastic chest band, while garments such as socks and hosiery include elastic leg bands. In other instances, the bands may provide a decorative or aesthetic effect to the garment.

Sewn seams have traditionally been used to secure bands to the garment edges; however, in applications where a band rests against the skin of the wearer, the sewn seams may be a source of physical and/or aesthetic discomfort. For example, the seams may cause chaffing and discomfort to the skin, and may be bulky so as to be seen through the outer clothing of the wearer.

Adhesives have been previously used to secure bands to garments. While adhered bands can resolve some of the discomforts associated with sewn seams, the adhered bands can lead to other deleterious effects. For example, the normal washing and drying cycles that typical garments are exposed to require the use of aggressive adhesives that may diminish the elasticity of the band and/or negatively effect the hand feel of the garment. Also, the manufacture of garments having adhered bands has proven to require additional process steps that lead to increased garment costs and decreased productivity.

The use of sonic energy, both subsonic and ultrasonic, to bond or weld (hereinafter "weld") materials having thermoplastic components has also been used to secure elastic bands to garments, such as in the disposable diaper industry. The process typically involves the use of high frequency mechanical vibrations that cause friction and melting at adjoining surfaces of the thermoplastic components, fusing them together in a strong molecular bond. Typically, the process includes pressing the materials to be joined between a vibrating horn and an anvil. The horn channels mechanical vibrations into the materials to fuse the materials at the location of the horn. While sonically welded elastic bands can result in increased productivity, they have not proven durable enough for many non-disposable garment applications.

Accordingly, there is a continuing need for garments having bands seamlessly secured thereto and processes for making such garments that resolve one or more deleterious effects and drawbacks of prior garments and processes.

BRIEF SUMMARY OF THE INVENTION

It is an object of the present invention to provide garments having bands seamlessly secured thereto.

It is another object to provide processes for seamlessly securing bands to garments.

These and other objects and advantages of the present invention are provided by a garment having a fabric layer and an edge band. The edge band and the fabric layer each include a sonically weldable material. In one embodiment, the garment comprises a sonic edge weld securing the edge band to the fabric layer along a cut edge of the garment, and an adhesive securing the edge band to the fabric layer.

Further objects and advantages are provided by a process for making a garment. One process includes: (1) placing an edge band on a fabric layer, the fabric layer and edge band each including a sonically weldable material, (2) applying sonic energy to the fabric layer and the edge band so that the fabric layer and the edge band are simultaneously trimmed along a cut edge and welded to one another along the cut edge, and (3) activating an adhesive between the fabric layer and the edge band to adhere the edge band to the fabric layer.

The above-described and other features and advantages of the present invention will be appreciated and understood by those skilled in the art from the following detailed description, drawings, and appended claims.

DETAILED DESCRIPTION OF THE INVENTION

Figure 1:
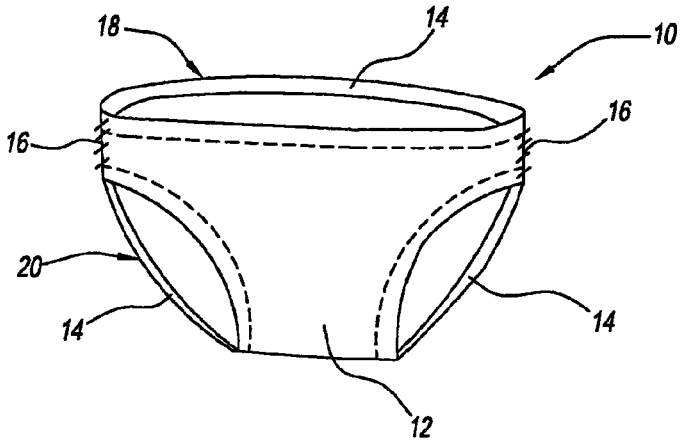
FIG. 1 is a perspective view of an exemplary embodiment of a garment according to the present invention.
Figure 2:
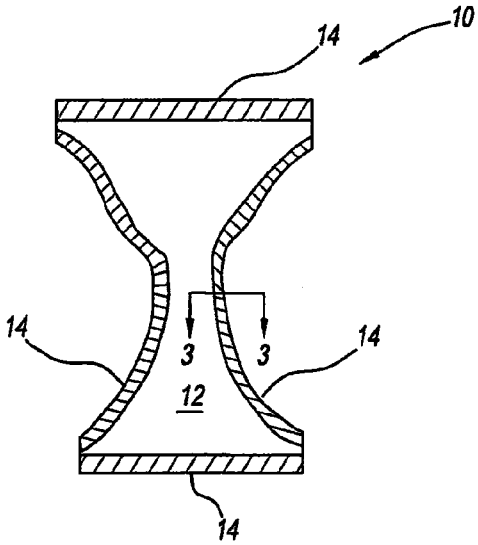
FIG. 2 is a view of the garment of FIG. 1 prior to the addition of side seams.
Figure 3:
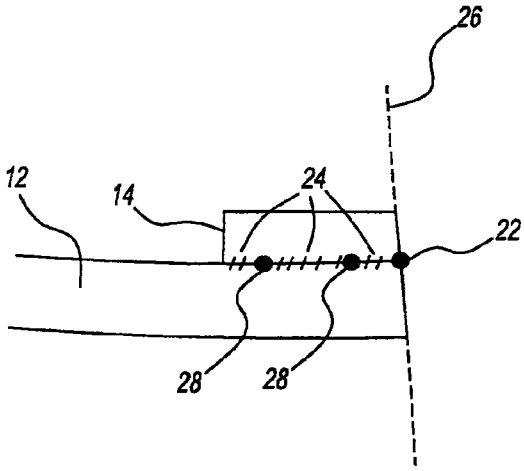
FIG. 3 is a sectional view taken along lines 3-3 of FIG. 2.

Referring to the drawings and in particular to FIGS. 1 and 2, an exemplary embodiment of a garment according to the present invention, generally referred to by reference numeral 10 is shown. Garment 10 includes a fabric layer 12 having an edge band 14 secured to one or more regions of the fabric layer. In the illustrated embodiment, garment 10 includes side seams 16 for securing portions of fabric layer 12 to one another.

Garment 10 is illustrated by way of example as a panty having an elastic edge band 14 secured to a waist region 18 and leg region 20. Of course, it is contemplated by the present invention for garment 10 to be any other apparel or clothing item such as, but not limited to, a brassiere, a shirt, a pair of pants, a coat, a sock, a pair of pantyhose, a bathing suit, a camisole, a boxer short, a men's brief, and any other clothing item having an edge band secured to any desired region.

In addition, garment 10 is illustrated by way of example having a single fabric layer 12. Of course, it is contemplated by the present invention for the garment to include more than one fabric layer 12.

Edge band 14 is seamlessly secured to fabric layer 12 by an edge weld 22 and an adhesive 24. As described in detail below, the energy input into garment 10 to define edge weld 22 may also simultaneously trim fabric layer 12 and edge band 14 to define a cut edge 26 of garment 10. Advantageously, edge weld 22 also seals cut edge 26 so that the free outer edge of fabric layer 12 and a free edge of the edge band 14 terminate at the same point and do not fray during use of garment 10. Further, the simultaneous cutting of fabric layer 12 and edge band 14 at cut edge 26 ensures that the fabric layer and band are co-planar at the cut edge. Thus, fabric layer 12 and edge band 14 are sonically welded to one another along cut edge 26 and are adhered to one another in the remaining portions where the band overlaps the fabric layer. In one embodiment, the adhesive 24 is applied along more than half of the inner surface of the edge band 14.

In some embodiments, edge band 14 may further be seamlessly secured to fabric layer 12 by one or more tack welds 28. As described in detail below, edge weld 22, and tack welds 28 if present, hold fabric layer 12 and edge band 14 in place with respect to one another during the manufacturing process prior to activation of adhesive 24.

Fabric layer 12 and/or edge band 14 may be formed of any non-woven fabric, woven fabric, or knitted fabric having between about ten percent and about one hundred percent of a sonically weldable material and all subranges therebetween. Sonically weldable materials include polypropylene, lycra spandex, tricot, polyester, nylon, acrylic, vinyl, PVC, thermoplastic urethane, or any combinations and blends thereof. Advantageously, fabric layer 12 and/or edge band 14 have up to about ninety percent natural fibers.

In one embodiment, fabric layer 12 and/or edge band 14 may be a blend of about sixty percent sonically weldable material and about forty-percent natural fibers. In another embodiment, fabric layer 12 is a blend of about twelve percent sonically weldable material and about eighty-eight percent natural fibers, while edge band 14 is a one hundred percent sonically weldable material. It is believed that fabric layer 12 and/or edge band 14 may include at least about 70 percent natural fibers.

The adhesive 24 may be any heat activated adhesive material. In some embodiments, adhesive 24 may impart a desired elasticity to garment 10. In other embodiments, edge band 14 alone, or in combination with adhesive 24, may impart a desired elasticity to garment 10. Thus, garment 10 may be provided with elasticity at its edges by adhesive 24, edge band 14, or any combination thereof.

Adhesive 24 is preferably a heat activated adhesive net or film. For example, adhesive 24 may be a heat activated adhesive net that provides elasticity to garment 10 such as the adhesive nets commercially available under the DELNET® tradename from Delstar Technologies of Austin, Tex. In another example, adhesive 24 may be a heat activated elastic film such as the adhesive films commercially available under the tradename SEWFREE® from Bemis Associates Incorporated of Shirley, Mass.

Figure 4:
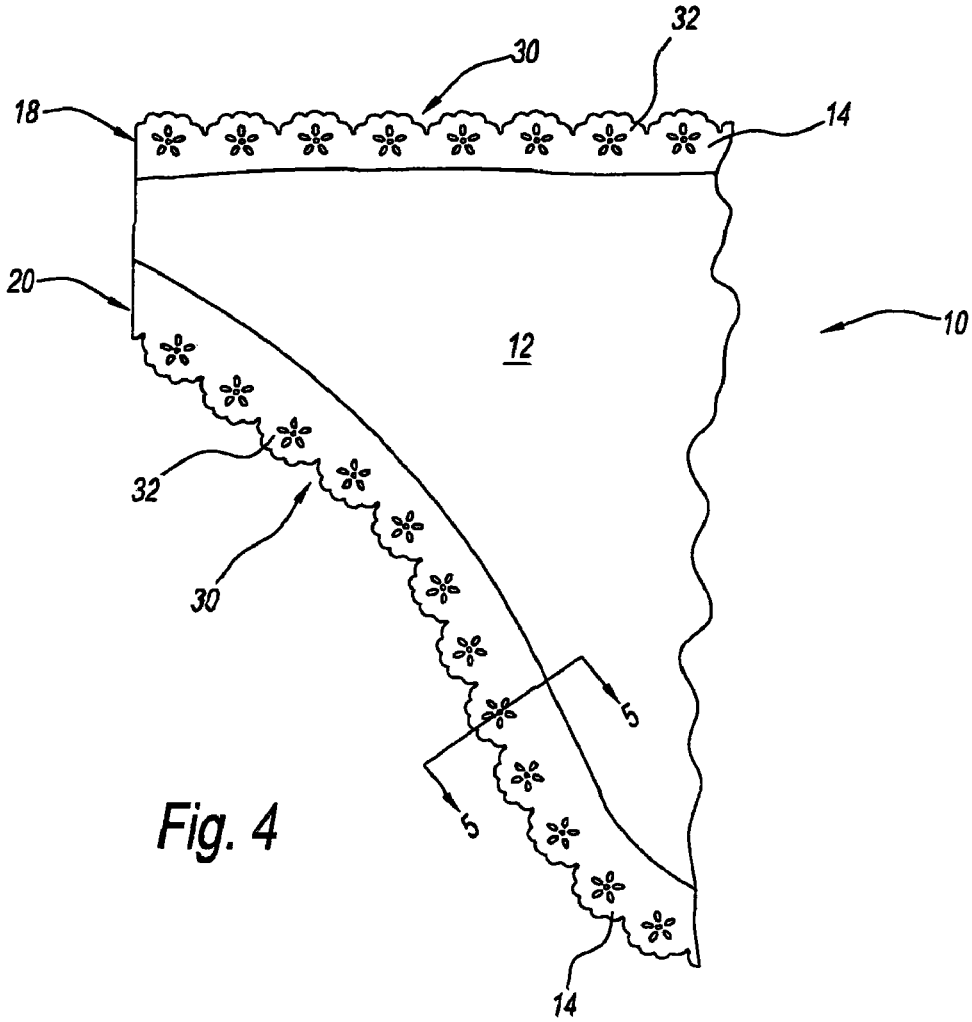
FIG. 4 is a view of a portion of an alternate exemplary embodiment of the garment of FIG. 1.
Figure 5:
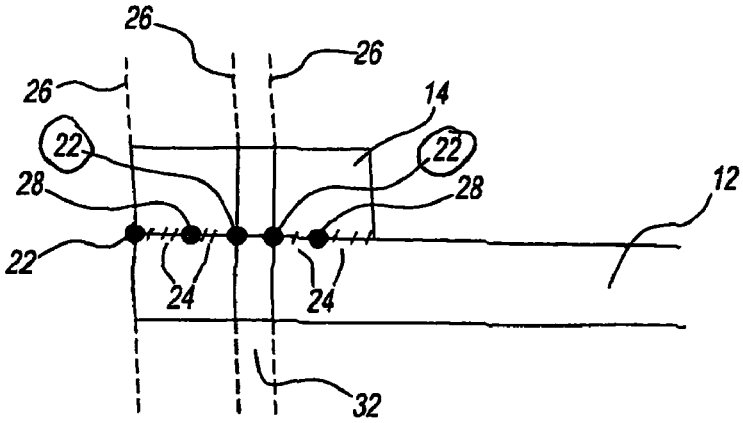
FIG. 5 is a sectional view taken along lines 5-5 of FIG. 4.

Referring now to FIGS. 4 and 5, an alternate exemplary embodiment of garment 10 is shown. Here, fabric layer 12 and edge band 14 are shown having various decorative features incorporated therein. For example, cut edge 26 is provided with a decorative pattern 30 such as, but not limited to, a scallop edge. Again, edge weld 22 is defined at decorative pattern 30 to seal cut edge 26.

In addition, fabric layer 12 and edge band 14 may include multiple cut edges 26 to provide garment 10 with a decorative effect 32, such as a lace effect. Here, an edge weld 22 is defined at each of the cut edges 26 of decorative effect 32.

In some embodiments, edge band 14 may further be seamlessly secured to fabric layer 12 by one or more tack welds 28. However, it has also been found that provision of multiple cut edges 26 and, thus, multiple edge welds 22, not only provides decorative effect 32, but also can mitigate the need for additional tack welds 28.

Figure 6:
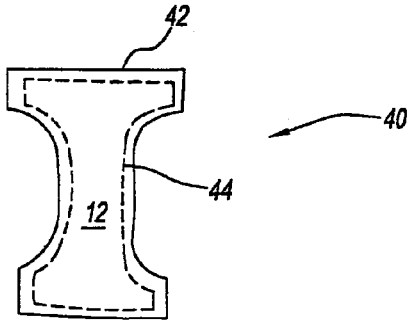
FIGS. 6 through 10 schematically depict an exemplary embodiment of a manufacturing process according to the present invention for the garment of FIG. 1.

An exemplary embodiment of a process 40 for making garment 10 is described with reference to FIGS. 6 though 10. During a first step of process 40 shown in FIG. 6, fabric layer 12 is trimmed to the approximate shape of the finished garment. For example, fabric layer 12 may be trimmed to define a selvage 42 outside a final garment shape 44 (illustrated in phantom).

Figure 7:
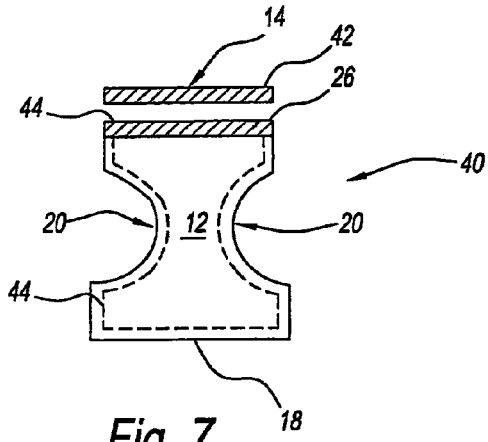

During a second step of process 40, shown in FIG. 7, edge band 14 is secured to fabric layer 12 along a portion of waist region 18. During the second process step, adhesive 24 and edge band 14 are placed on fabric layer 12 to cover a portion of selvage 42 and a portion of final garment shape 44.

In a preferred embodiment, adhesive 24 is laminated on edge band 14 prior to placement of the edge band on fabric layer 12. Here, edge band 14 is placed on fabric layer 12 so that adhesive 24 is in contact with the fabric layer.

As edge band 14 and adhesive 24 are placed on fabric layer 12, the edge band, adhesive, and fabric layer are sonically cut and welded along final shape 44 to define edge weld 22 (not shown) and cut edge 26. Selvage 42 having both fabric layer 12 and edge band 14 is removed and discarded. In some embodiments, fabric layer 12 and edge band 14 are also sonically welded to define tack welds 28 (not shown). Accordingly, the second process step applies sonic energy with sufficient intensity to simultaneously cut fabric layer 12, adhesive 24, and edge band 14 along cut edge 26 and weld the fabric layer and edge band to one another at edge weld 22 and, if present, at tack welds 28. For example, it is contemplated for process 40 to expose fabric layer 12 and edge band 14 to sonic energy of between about 20 and 60 kilohertz (kHz) and a pressure of between about 20 and 40 pounds per square inch (psi).

In a preferred embodiment, the second process step of process 40 is carried out using a sealing and bonding machine commercially available under the tradenames SEAMMASTER or LACEMASTER from Sonobond Ultrasonics of West Chester, Pa.

At this point, fabric layer 12 and edge band 14 are held in place with respect to one another by edge weld 22 and, if present, by tack welds 28. The sonic energy that creates cut edge 26 and welds 22, 28 also locally activates adhesive 24. Thus, welds 22, 28 include components of fabric layer 12, edge band 14, and adhesive 24 in addition to a localized area of activated adhesive surrounding around the welds. However, adhesive 24 remains un-activated in the remaining portions of overlap between fabric layer 12 and edge band 14.

Figure 8:
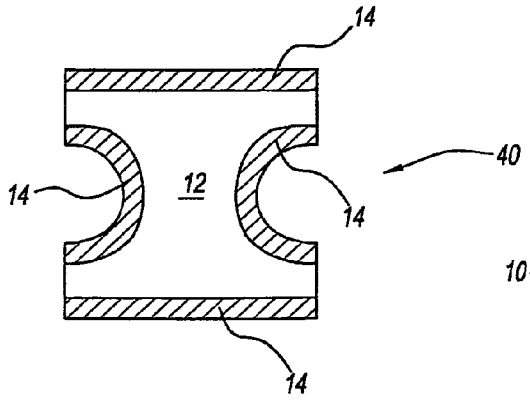

During a third step of process 40, shown in FIG. 8, the second process step is repeated to secure edge band 14 to the remaining waist and leg regions 18, 20, as desired. Again, fabric layer 12 and edge band 14 are held in place with respect to one another by the sonic welds, but adhesive 24 remains largely un-activated.

Process 40 can be easily modified to provide tack welds 28, decorative pattern 30, and/or decorative effect 32 as desired. For example, the horn used to apply sonic energy during the second and third steps may be modified using known methods to provide the tack welds 28, decorative pattern 30 and/or decorative effect 32, as desired.

Figure 9:
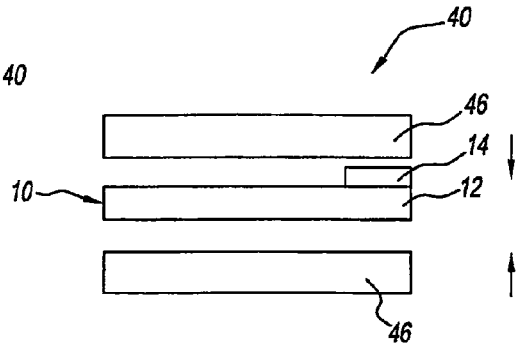

During a fourth step of process 40, shown in FIG. 9, adhesive 24 is activated. For example, fabric layer 12 and edge band 14 may be compressed between a pair of presses 46 at a pressure, temperature, and/or time sufficient to activate adhesive 24. At the end of the fourth step, fabric layer 12 and edge band 14 are secured to one another by edge weld 22, adhesive 24, and tack welds 28, if any.

Figure 10:
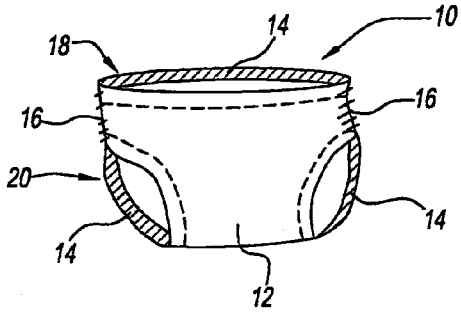

Finally, garment 10 may be completed by folding the garment and adding side seams 16 for securing portions of fabric layer 12 to one another, as shown in FIG. 10.

Advantageously, process 40 uses sonic welds 22, 28 to hold fabric layer 12 and edge band 14 in place with respect to one another while cutting through both the edge band and fabric, so that the edges are co-planar with one another. Process 40 then activates adhesive 24 to firmly secure edge band 14 to fabric layer 12 without deleteriously effecting the elastic characteristics of the edge band or the hand feel of the edge band and fabric. It has been determined that the combination of edge weld 22 and adhesive 24, as well as tack welds 28 if present, provide garment 10 with a desired durability, washability, hand feel, and method of manufacture not previously possible.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed, but that the disclosure will include all embodiments falling within the scope of the appended claims.

What is claimed is:

1. A method of forming a garment, comprising:

providing a knitted or woven fabric layer comprising a sonically weldable material, the fabric layer having an inner surface and at least one of an arm opening region, a neck opening region, a waist opening region, and leg opening region, the at least one opening region having a periphery and an outer free edge;

placing an elastic edge band comprising a sonically weldable material around the entire periphery only of the at least one opening region, the edge band having first and second free edges and an inner surface;

the entire inner surface of the edge band overlying and in contact with only the inner surface of the fabric, and the first free edge of the edge band terminating at the outer free edge of the fabric layer;

securing the first free edge of the edge band to the outer free edge of the at least one opening region with a subsonic or ultrasonic edge weld to form a finished seamless edge along the at least one opening region; and activating an adhesive along more than half of the inner surface of the edge band to secure the edge band and second free edge to the inner surface of the fabric layer.

2. The method of claim 1, further comprising forming a plurality of subsonic or ultrasonic tack welds to secure the edge band to the fabric layer.

3. The method of claim 1, wherein the adhesive is an adhesive net or an adhesive film.

4. The method of claim 1, wherein the fabric layer and edge band are simultaneously trimmed along at least the seamless edge to define a decorative pattern.

5. The method of claim 1, wherein the fabric layer and the edge band each comprise between about ten percent and one hundred percent of subsonically or ultrasonically weldable material.

6. The method of claim 1, wherein at least one of the fabric layer and the edge band comprise up to about ninety percent natural fibers.

7. The method of claim 1, wherein the garment is selected from the group consisting of a panty, a brassiere, a shirt, a pair of pants, a coat, a sock, a pair of pantyhose, a bathing suit, a camisole, a boxer short, and a men's brief.

* * * * *